US009695559B2

(12) United States Patent
Garcia

(10) Patent No.: US 9,695,559 B2
(45) Date of Patent: Jul. 4, 2017

(54) TRANSITION SLAB BETWEEN THE ABUTMENT AND THE DECK OF A BRIDGE WITH EXPANSION AND CONTRACTION JOINTS HAVING A LONG SERVICE LIFE, AND METHODS FOR ABSORBING THE EXPANSION AND CONTRACTION MOVEMENTS OF THE DECK OF A BRIDGE

(71) Applicant: INGETURARTE, S.L., Madrid (ES)

(72) Inventor: Jorge Aparicio Garcia, Madrid (ES)

(73) Assignee: INGETURARTE, S.L., Madrid (ES)

( * ) Notice: Subject to any disclaimer, the term of this patent is extended or adjusted under 35 U.S.C. 154(b) by 0 days.

(21) Appl. No.: 15/029,278

(22) PCT Filed: Oct. 13, 2014

(86) PCT No.: PCT/ES2014/070747
§ 371 (c)(1),
(2) Date: Apr. 14, 2016

(87) PCT Pub. No.: WO2015/055876
PCT Pub. Date: Apr. 23, 2015

(65) Prior Publication Data

US 2016/0258121 A1 Sep. 8, 2016

(30) Foreign Application Priority Data

Oct. 18, 2013 (ES) ..... 201300915

(51) Int. Cl.
*E01D 19/00* (2006.01)
*E01D 19/06* (2006.01)
*E01D 19/02* (2006.01)
*E01D 101/10* (2006.01)
*E01D 101/26* (2006.01)

(52) U.S. Cl.
CPC ..... *E01D 19/06* (2013.01); *E01D 19/02* (2013.01); *E01D 19/067* (2013.01); *E01D 2101/10* (2013.01); *E01D 2101/26* (2013.01)

(58) Field of Classification Search
CPC ... E01D 19/06; E01D 19/067; E01D 2101/10; E01D 2101/26
USPC ..... 14/2, 21, 73, 73.1, 785; 404/17
See application file for complete search history.

(56) References Cited

U.S. PATENT DOCUMENTS 3,732,021 A * 5/1973 Rizza ..... E01D 19/062 14/73.1
4,087,191 A * 5/1978 Brady ..... E01D 19/062 14/73.1
4,339,214 A * 7/1982 Puccio ..... E01D 19/062 14/73.1

(Continued)

*Primary Examiner* — Raymond W Addie
(74) *Attorney, Agent, or Firm* — Avery N. Goldstein; Blue Filament Law PLLC

(57) ABSTRACT

A transition slab connected at opposing ends to a deck compression slab and to an anchoring. The transition slab absorbs the expansions of the deck by means of compressing sheets of polymer, elastomer or the like, that are arranged in parallel spacing and integrated in the transition slab to be oriented perpendicular to the longitudinal direction of the road. The transition slab absorbs the contraction movements of the deck limited expansion due to the summation of crack openings in induced cracks. Crack planes are created by forms made of wood, polymer or the like arranged in parallel, spaced relation within the body of the transition slab.

9 Claims, 3 Drawing Sheets

(56) References Cited

U.S. PATENT DOCUMENTS

| | | | | |
|---|---|---|---|---|
| 5,048,249 | A * | 9/1991 | Shreiner | E01C 11/126 404/64 |
| 7,946,784 | B2 * | 5/2011 | Knak | E03F 5/06 14/73.1 |
| 8,671,489 | B2 * | 3/2014 | Gallai | E01C 11/103 14/73.1 |
| 2004/0016065 | A1 * | 1/2004 | Steiger | E01D 19/062 14/73.1 |

* cited by examiner 1
7
8
9
10
11
12
13
14
15
16
17
18
19
20

TRANSITION SLAB BETWEEN THE ABUTMENT AND THE DECK OF A BRIDGE WITH EXPANSION AND CONTRACTION JOINTS HAVING A LONG SERVICE LIFE, AND METHODS FOR ABSORBING THE EXPANSION AND CONTRACTION MOVEMENTS OF THE DECK OF A BRIDGE

FIELD OF THE ART

The present invention relates to a transition slab between the abutment and the deck of a bridge with expansion and contraction joints having a long service life, and a method for absorbing the expansion and contraction movements of the deck of a bridge. It is an alternative that provides a long service life for conventional expansion joints in abutments.

STATE OF THE ART

In bridges, the expansion and contraction joints between the end of the deck and its abutment have been a problem to be solved because they create interruptions on the paved road surface for vehicles, and because the deck expands due to an increase in temperature and contracts due to drops in temperature in addition to the effects of retraction, pre-stressing and creep, with respect to the abutments. The mentioned expansion and contraction joints of the ends of the deck are usually solved with elastomeric joints, finger joints or modular joints, which are placed transverse to the longitudinal direction of the bridge. These conventional joints are placed between the end of the deck and the haunch of the abutment in a non-integral bridge.

These conventional joints are placed at the end of the transition slab that is arranged in continuity with the compression slab of the deck at one end and in continuity with the road foundation at the opposite end, in an integral bridge.

The service life of the joints is between five and fifteen years, and they must be replaced due to integrity loss caused by traffic and other activities.

The conventional joints allow the passage of water to the abutments

The conventional joints are points of energy loss for the vehicle due to the impact of said vehicle on the mentioned joints.

The conventional joints, combined with the skewing thereof, with respect to the direction of the road are very dangerous for motorcycles.

Thus, there is a need for longer lasting joints.

There is a need to prevent to the greatest extent possible the entry of water into the abutment.

There is also a need to reduce the opening of the gap of the joints so that driver safety is not compromised.

JP2006328867A teaches a conception similar to the transition slab, but it places an expansion and contraction joint at the end thereof opposite the deck, such as in integral bridges, instead of making several joints having a small opening in cracks forced in the transition slab, such as it is the case in this invention.

CN200980117187.0A and CN200980117187.0B introduces a conception similar to the transition slab, but with the expansion and contraction joint being located at the end thereof furthest from the deck, instead of making several joints having small openings in cracks forced in the transition slab, such as it is the case in this invention.

BRIEF DESCRIPTION OF THE INVENTION

A compression slab of the deck is connected to a transition slab made of reinforced concrete. The transition slab is connected with concrete to an anchoring, and a static fixed plane is located in said junction.

The mentioned transition slab contracts absorbing the expansions of the deck by means of the compression of sheets of polymer, elastomer or the like, although these movements could be absorbed by the ground and the invention may not include the sheets. These thin layers of polymer, elastomer or the like are arranged parallel to and spaced a distance from one another and integrated in the transition slab perpendicular to the longitudinal direction of the road.

The transition slab absorbs the contraction movements of the deck by means of the expansion of the transition slab due to the summation of crack openings, which are induced and spaced a distance from one another.

All of the crack planes, or map of crack planes, are forced by forms made of wood, polymer or the like arranged in parallel, spaced apart and integrated in the transition slab, perpendicular to the longitudinal direction of the road.

An asphalt paved surface arranged on the transition slab protects the slab.

The induced cracks may appear on the top part of the asphalt paved surface, but not wider than 3 mm which would not entail a problem for the driver or the vehicles. The transition slab rests on the ground of the platform of the abutment, which is heavily compacted to withstand vertical actions, and the transition slab behaves like an accordion in view of contraction and expansion actions of the deck, and could be made on a layer having a low coefficient of friction with the concrete.

This remarkable transition slab allows developing maps of cracks in a controlled manner, such that they allow the contraction movements of the deck in relation to the abutment and absorbing the expansion movements as a result of the suitable number of thin compressible layers parallel to the crack surfaces.

The transition slab can be prefabricated or made in situ by means of conventional methods.

Therefore, the problems to be solved involve obtaining an expansion and contraction joint having a long service life between the compression slab of the deck and the abutment of a bridge, both for building new bridges and for restoring existing bridges, eliminating interruptions for vehicle users.

These objectives are achieved with a special transition slab made of reinforced concrete including:

any conventional connection for connecting the transition slab to the compression slab of the deck as justified by the construction regulations;

any concrete connection for connecting the transition slab to an anchoring block or to any fixed transverse alignment achieved by another method, located on an opposite side regarding the deck and as justified by the construction regulations;

concrete with or without retraction for the transition slab;

rebars for suitably sewing the forced induced cracks;

rebars for transverse force distribution;

thin layers of polymer, elastomer or similar material (thickness between about 0.5 and 3 mm) to allow the expansion movements of the deck;

formed polymers or woods (having a thickness between about 0.5-2 cm) to force a map of cracks perpendicular to the longitudinal direction of the road such that they can absorb the contraction movements of the bridge by means of the summation of the crack openings induced; and a ground base under the slab which is properly compacted against the abutment.

This expansion and contraction joint in the form of a reinforced slab provides a remarkable solution to solve the problems of deck expansion and contraction in relation to the abutments, increasing durability over time and preventing bumps for road users.

BRIEF DESCRIPTION OF THE DRAWINGS

The invention is better understood with the aid of the graphical description given by way of example and illustrated by the drawings in which.

DETAILED DESCRIPTION OF AN INVENTIVE EMBODIMENT

The present invention will now be described more completely with reference to the attached drawings in which the element is shown. This invention can however be carried out in many different ways and should not be interpreted as being limited to those mentioned in the present document, but rather, the invention is provided so that this complete and thorough description fully transmits the scope of the invention to the persons skilled in the art.

Figures 1A, 1B, 1C:
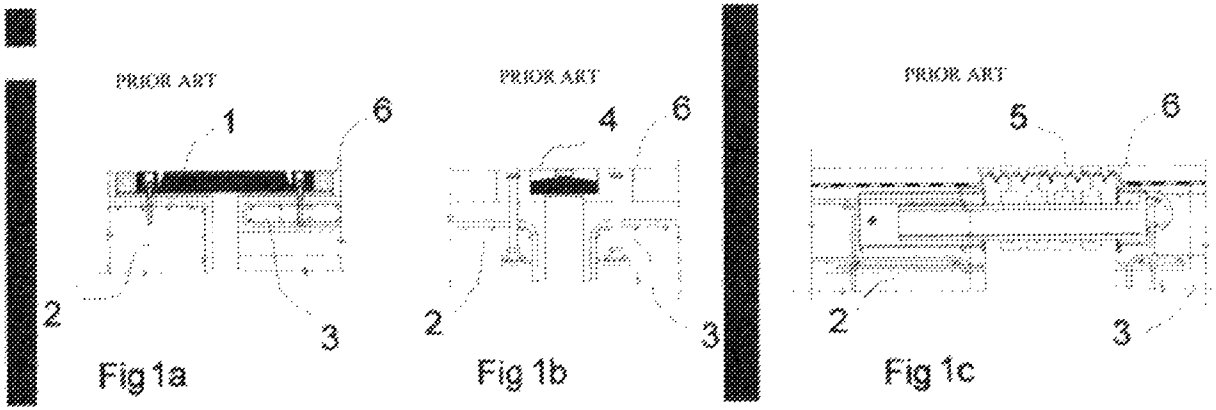
FIG. 1*a* teaches an elastomeric expansion joint known in the state of the art, located between the abutment and the compression slab of the deck of the bridge.
FIG. 1*b* illustrates a finger expansion joint known in the state of the art, located between the abutment and the compression slab of the deck of the bridge.
FIG. 1*c* shows a modular expansion joint known in the state of the art, located between the abutment and the compression slab of the deck of the bridge.

FIG. 1*a* shows a prior art elastomeric expansion joint 1, located between the abutment 2 and the compression slab of the deck of the bridge 3;

FIG. 1*b* shows a prior art finger expansion joint 4, located between the abutment 2 and the compression slab of the deck of the bridge 3;

FIG. 1*c* prior art shows a modular expansion joint 5, located between the abutment 2 and the compression slab of the deck of the bridge 3;

wherein the number 6 indicates the paved road surface.

Figures 2A, 2B, 2C, 3:
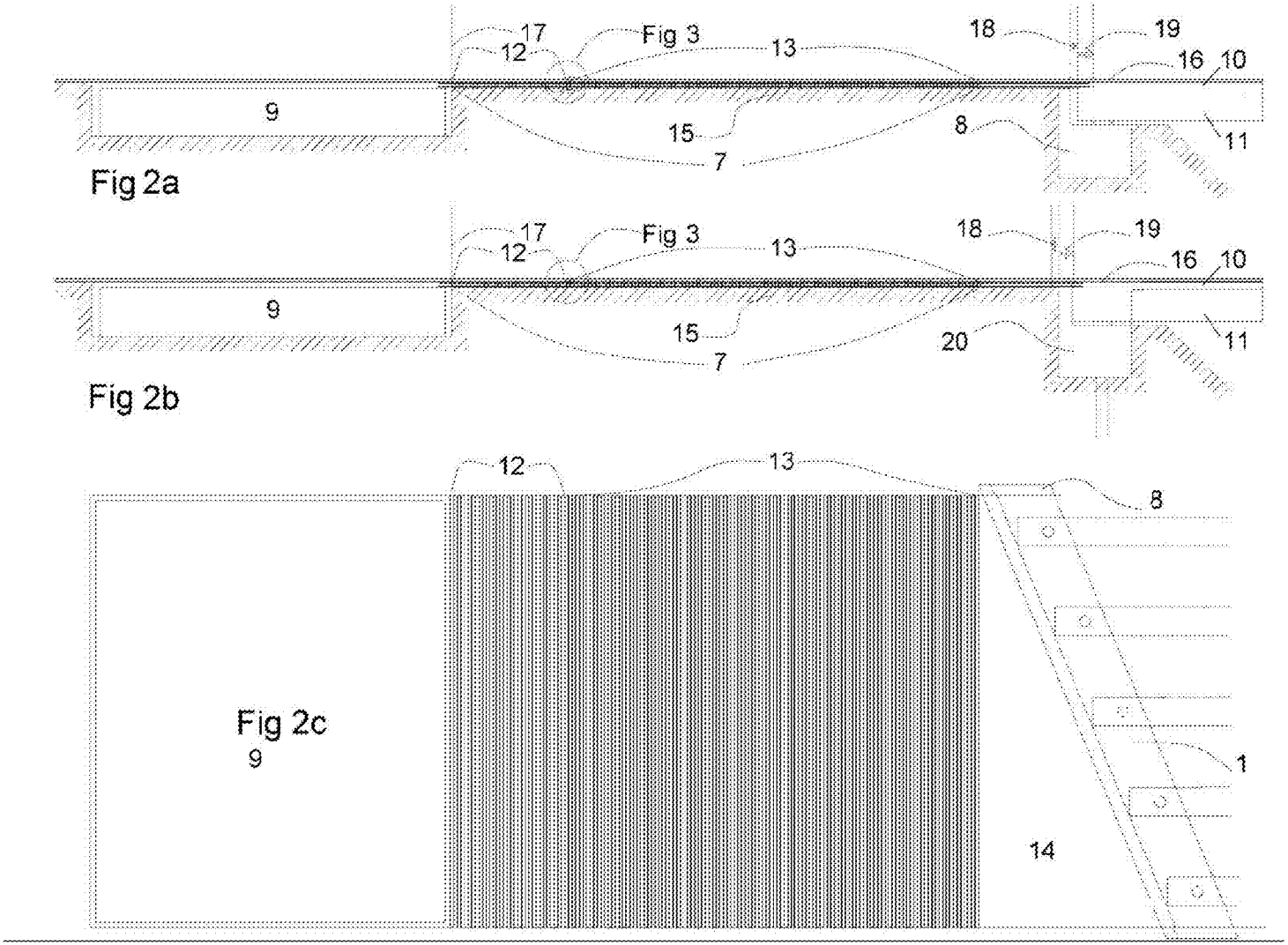
FIG. 2*a* shows, by means of a longitudinal section of the junction between the deck, the abutment and of the platform of said abutment in the longitudinal direction of the road, the location of a transition slab with expansion and contraction joints located in the section of a semi-integral abutment.
FIG. 2*b* shows, by means of a longitudinal section of the junction between the deck, the abutment and of the platform of said abutment in the longitudinal direction of the road, the location of a transition slab with expansion and contraction joints in the section of an integral abutment.
FIG. 2*c* illustrates, by means of a plan view, the location of the novel transition slab with expansion and contraction joints.
FIG. 3 shows the constructive detail of the transition slab with expansion and contraction joints.
Figure 3:
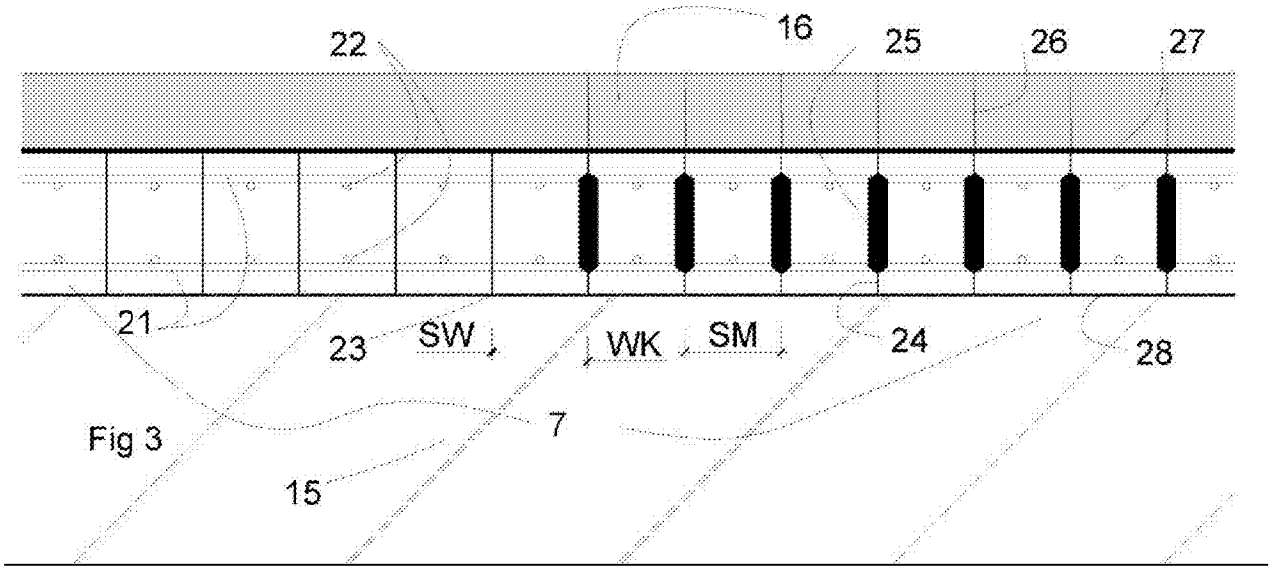

FIG. 2*a* shows the location of the expansion and contraction joint in the transition slab 7, in the section of a semi-integral abutment 8.

The expansion and contraction joint in the transition slab 7 is located between the anchoring 9 and the compression slab 10 of the deck 11.

Part 12 of the transition slab 7 absorbs the expansion of the deck 11, another part 13 of the transition slab 7 absorbs the contractions of the deck 11.

The invention includes the possibility of accommodating any skewing 14 of the abutment as a result of a triangular screeding of the slab.

The invention must be carried out on a properly compacted fill 15.

The asphalt paved surface 16 on the slab protects said slab.

A static fixed plane 17 is located at the end of the anchoring 9 with the expansion and contraction joint in the transition slab 7.

The expansion movement of a vertical portion 18 of the deck 11 is absorbed by the contraction of the transition slab 7 due to the compression of the sheets or layers 23 of polymer, elastomer or the like, the thickness of which is SW, typically between about 0.5 and 3 mm.

The contraction movement of a vertical portion 19 of the deck 11 is absorbed by the expansion of the transition slab 7 due to the summation of the crack openings 24 of the induced cracks the characteristic width of which is WK, typically not wider than 3 mm, and the spacing between crack planes SM.

FIG. 2*b* shows a similar location of the expansion and contraction joint in the transition slab 7 in the section of an integral abutment 20;

FIG. 2*c* shows the location of the novel expansion and contraction joint in a plan view. This drawing depicts a deck 11 composed of beams, but any other type of deck 11 can be possible.

FIG. 3 shows the constructive detail of the expansion and contraction joint in the transition slab 7, centered in the part in which they limit the area 12 of the transition slab allowing the expansion of the deck 11, with the part 13 of the transition slab allowing the contraction of the deck 11;

The thin layers 23 of polymer, elastomer or the like are arranged in parallel and having a thickness of SW, allow the expansion movements of the deck 11, although these movements could be absorbed by the ground and the invention may not comprise the layers 23;

Forms 25 made of wood, polymer or the like arranged for forcing the suitable map of crack planes 24 parallel to and spaced a distance SM from one another, the openings WK of which are perpendicular to the longitudinal direction of the road, and which can absorb the contraction movements of the deck 11 through the summation of all the crack openings in the induced cracks $\Sigma WK=19$;

The spacing SM can be variable.

The longitudinal rebars 21 sew the cracks 24 of the slab 7;

The transverse rebars 22 aid in transverse force distribution;

The cracks of the slab may appear on the top part of the asphalt paved surface 26, but not wider than 3 mm which would not entail a problem for the drivers or the vehicles;

An impermeable layer 27 should be placed between the asphalt paved surface 16 and the slab 7.

A sliding layer 28 is placed between the properly compacted ground 15 and the slab 7.

The foregoing detailed description in reference to the drawings illustrates rather than limits the invention. There are various alternatives that fall within the scope of the attached claims. The word "comprises" does not exclude the presence of elements or steps other than those listed in a claim. The word "a" or "an" preceding an element or a step does not exclude the presence of a plurality of such elements or steps. The mere fact that the respective dependent claims define respective additional features does not exclude a combination of additional features corresponding to a combination of dependent claims.

The invention claimed is:

1. A transition slab between an abutment and a deck of a bridge with expansion and contraction joints, said transition slab resting on the ground of a platform of the abutment which is heavily compacted to withstand vertical actions, and linking up with a road, said transition slab integrating:

reinforced concrete with rebars for transverse force distribution;

a first connection for connecting one side of the transition slab with a compression slab of the deck;

a second connection for connecting an anchoring with the opposite side of said transition slab;

wherein said transition slab comprises:

forced crack planes that are parallel to and spaced from one another, the crack openings of which are perpendicular to the direction of the road;

wood or polymer in thin forms of about 0.5-2 cm, such that they force the suitable mapping of the crack planes perpendicular to the longitudinal direction of the road which can absorb the contraction movements of the deck through the summation of the crack openings in the forced cracks, and rebars suitably sewing the forced cracks between the deck and the anchoring block.

2. The slab according to claim 1, wherein it has polymers or elastomers having a low modulus of elasticity arranged in thin layers or sheets of about 0.5-3 mm to allow expansion movements of the deck.

3. The slab according to claim 1, wherein an asphalt paved surface is arranged on said transition slab.

4. The slab according to claim 1, wherein said transition slab is produced in situ.

5. The slab according to claim 1, wherein said transition slab is prefabricated.

6. The slab according to claim 1, wherein said transition slab is made on a layer having a low coefficient of friction with the concrete.

7. The slab according to claim 2, wherein an asphalt paved surface is arranged on said transition slab.

8. A method for absorbing the contraction movements of a deck of a bridge, wherein the method comprises:

interposing a transition slab, according to the features described in claim 1, between the deck of the bridge and the abutment, for absorbing the contraction movements of the deck by means of the summation of several crack openings in forced cracks in the transition slab.

9. The method according to claim 8, wherein the method further comprises including in the transition slab thin layers or sheets of about 0.5-3 mm of polymers or elastomers having a low modulus of elasticity for further absorbing the expansion movements of the deck by means of the contraction of said layers or sheets.

* * * * *